US006918645B2

(12) United States Patent
Takahashi

(10) Patent No.: US 6,918,645 B2
(45) Date of Patent: Jul. 19, 2005

(54) BATTERY-OPERABLE PRINTER

(75) Inventor: Yasuo Takahashi, Fuchu (JP)

(73) Assignee: Olympus Corporation, Tokyo (JP)

( * ) Notice: Subject to any disclaimer, the term of this patent is extended or adjusted under 35 U.S.C. 154(b) by 176 days.

(21) Appl. No.: 09/925,296

(22) Filed: Aug. 9, 2001

(65) Prior Publication Data

US 2002/0033872 A1 Mar. 21, 2002

(30) Foreign Application Priority Data

Aug. 21, 2000 (JP) ..... 2000-249915
Aug. 6, 2001 (JP) ..... 2001-238323

(51) Int. Cl.[7] ..... B41J 29/38; B41J 29/393; B41J 2/01

(52) U.S. Cl. ..... 347/16; 347/19; 347/104

(58) Field of Search ..... 347/109, 19, 110, 347/14; 400/703, 711, 712, 14

(56) References Cited

U.S. PATENT DOCUMENTS 5,631,677 A * 5/1997 Horigome et al. ..... 347/19
6,067,101 A * 5/2000 Arakawa et al. ..... 347/19
6,247,777 B1 * 6/2001 Shimoda ..... 347/14

FOREIGN PATENT DOCUMENTS

| | | | |
|---|---|---|---|
| JP | 1166979 | * | 6/1989 |
| JP | 04-200185 | | 7/1992 |
| JP | 11-177912 | | 7/1999 |

* cited by examiner

*Primary Examiner*—Melvin S Brooke
*Assistant Examiner*—Ly T Tran
(74) *Attorney, Agent, or Firm*—John C. Pokotylo; Straub & Pokotylo

(57) ABSTRACT

In a thermal transfer printer driven by a battery power source, to perform a print operation, the remaining capacity level of the battery power source (remaining battery capacity level) is detected by a voltage detector immediately before paper is fed out of a paper cassette and transferred for printing. The detected remaining battery capacity level is compared with a criterion level, which is a print-driving power required for one sheet of paper. If the remaining battery capacity level is lower than the criterion level, control is performed to stop the commencement of a print-driving operation. Thereby, the battery-driven printer averts printing from being terminated partway because of depletion in the battery power, and furthermore, enables printed sheets of the paper to utmost be increased.

19 Claims, 7 Drawing Sheets

BATTERY-OPERABLE PRINTER

This application claims benefits of Japanese Patent Application No. 2000-249915 filed on Aug. 21, 2000, and No. 2001-238323 filed on Aug. 6, 2001, the contents of which are incorporated by this reference.

BACKGROUND OF THE INVENTION

1. Field of the Invention

The present invention relates to a battery-operable printer, and more particularly, relates to a printer having a function for checking whether remaining battery capacity has a battery-capacity level sufficient to perform paper transfer operations and print operations, (Hereinbelow, the "paper" refers to paper on which printing is to be performed).

2. Description of the Related Art

In recent years, object images taken by electronic image pickup devices are displayed on a display unit and/or are printed on paper for viewing and preservation.

With technical advances toward compactness and high pixel density of electronic image pickup elements, lightweight and compact electronic image pickup devices have been developed, and are practically used. With the advent of such compact and lightweight electronic image pickup devices, demands are made for compact and lightweight portable printers for printing object images taken by the electronic image pickup devices. In particular, demands are increased for portable printers capable of printing still images of objects taken by the electronic image pickup devices on paper. A conventional example of the portable printers can be operated by two power sources, i.e., one is a commercial power source, and the other is a battery power source. The printer can therefore be driven by the battery power source to perform print operation when the printer is hand-carried.

However, when the portable printer is operated using the battery to perform printing, problem occur. In the printer, print operation may be forced to terminate because of depletion in the battery power. In addition, when printing is resumed after the battery has been replaced, problems such as deviations and the like can occur in print positions before printing terminates and after printing has resumed. To prevent the problems such a print termination and print-positional deviations, techniques have been proposed. Japanese Unexamined Patent Application Publications No. 4-200185 and No. 11-177912, each of which disclose a printer including a function of checking whether the remaining battery capacity is at a level sufficient to perform printing to produce a desired number of sheets.

Japanese Unexamined Patent Application Publication No. 4-200185 discloses a camera with a built-in printer as a battery-powered portable apparatus having a print function. Before an image captured by the camera is printed, battery-capacity checking is performed. If the battery capacity is sufficient, printing is performed. However, if the battery capacity is not sufficient, a display unit displays a warning, and processing terminates.

Japanese Unexamined Patent Application Publication No. 11-177912 discloses a technique similar to those introduced above. According to the technique, a power-source detecting circuit, a warning unit, and a print-information preserving unit are provided in a control circuit that controls a printer. When the print size and the number of sheets are specified, and a print-commencing command is input to the printer, the control circuit drives and controls the power-source detecting circuit to detect the remaining capacity of a power-source battery, and determines whether the printer is capable of performing printing meeting the input requirements for the print size and the number of sheets. If a shortage is foreseen to occur in the remaining capacity of the power-source battery which is required to perform printing meeting the input requirements, the control circuit forcibly disables the print operation and controls the warning unit to display information prompting a user to replace the power-source battery with a new one.

The above-described determination is made based on the amount of power consumption per sheet as a coefficient. The amount of power consumption is obtained by performing experiments. Based on the coefficient, the determination is made whether printing can be performed on the specified number of sheets by using the remaining capacity of the power-source battery.

As described above, in the printer disclosed in Japanese Unexamined Patent Application Publication No. 11-177912, when printing is commenced after the print requirements have been input, the remaining capacity of the power-source battery is detected. Then, the determination is made whether the power-source battery is at a level sufficient to execute printing meeting the input print requirements. If the remaining capacity of the power-source battery is not at a level sufficient to execute printing meeting the input print requirements, the print operation is forced to terminate. Concurrently, the display unit displays information prompting the user to replace the power-source battery with a new one.

The above-described printer is included in an electronic image pickup device. A new object image can be captured during a print operation of an object image captured by the electronic image pickup device. In this case, an electronic image pickup operation is performed by interrupting the print operation, and after the electronic image pickup operation has been completed, printing for the object image for which the print operation was performed partway is resumed from the position where printing stopped.

In the above-described printer, roll-shaped paper is used, and an inkjet recording method is employed. The printer includes a memory to store image data corresponding to one scanning operation according to the inkjet recording method. During a print operation, an electronic image pickup operation is performed after one scanning operation of image data recorded in the memory. After the electronic image pickup operation has been completed, printing is resumed from image data corresponding to one scanning operation that is performed subsequent to a scanning operation of a printed image. Thereby, the position where printing terminated partway and the position wherefrom printing has resumed is apparent for each print scanning operation, and no positional deviation therefore occurs. This can be achieved with a printer that employs the inkjet printing method.

However, with a printer employing a recording method, such as a dye fusion thermal transfer recording method or a dye diffusion thermal transfer recording method, a driving battery of the printer is depleted in a relatively short period. When printing is thereby terminated in print operation, a thermal-transferring inked ribbon tends to stop in a state where the ribbon is in contact with paper. When printing is resumed after the battery has been replaced with a new one, driving systems for the inked ribbon and the paper are driven to commence printing from the position where printing terminated partway. For this reason, deviations occur in the print-commencement position, and variations occur in the thermal-transfer temperature. Consequently, differences in density and coloration occur on printed portions where printing terminated partway and printing is resumed.

According to Japanese Unexamined Patent Application Publication No. 4-200185, battery-capacity checking is performed before a sheet of recording paper is transferred, but nothing is disclosed regarding a method of increasing number of sheets of the paper to as many as possible. The method is required when printing is performed on a large number of sheets of the paper.

SUMMARY OF THE INVENTION

An object of the present invention is to provide a battery-operable printer that prevents printing from being terminated partway because of depletion of the battery and that prevents unnecessary paper stagnation which occurs in a paper transfer path when paper transfer terminates partway because of a shortage in battery power.

A printer of the present invention includes a printing section for performing printing on paper; a paper feed section for transferring paper, which is fed from a paper feed cassette, to the aforementioned printing section; a battery power source; and a remaining-battery-capacity detector for detecting a remaining-battery-capacity level of the aforementioned battery power source. Furthermore, the printer includes a print-operation-commencement specifying section for specifying print-operation commencement, and a control section.

The aforementioned control section performs print-operation control such that the aforementioned remaining-battery-capacity detector is used to detect the remaining battery capacity level immediately before a paper-feed operation is commenced for the first sheet of the paper for a print operation which is commenced corresponding to a print-operation commencement specification received from the aforementioned print-operation-commencement specifying section. On the other hand, the aforementioned control means performs the print-operation control such that when printing is consecutively performed on a plurality of sheets of the paper corresponding to the aforementioned print-operation commencement specification, the aforementioned remaining-battery-capacity detector is used to detect the remaining battery capacity level immediately before the paper-feed operation is performed for the print operation for each of the plurality of sheets of the paper.

The above and other objects, features, and advantages of the invention will become more clearly understood from description referring to the accompanying drawings.

DESCRIPTION OF THE PREFERRED EMBODIMENTS

Hereinbelow, embodiments of the present invention will be described with reference to the accompanying drawings.

First, a first embodiment will be described.

Figure 1:
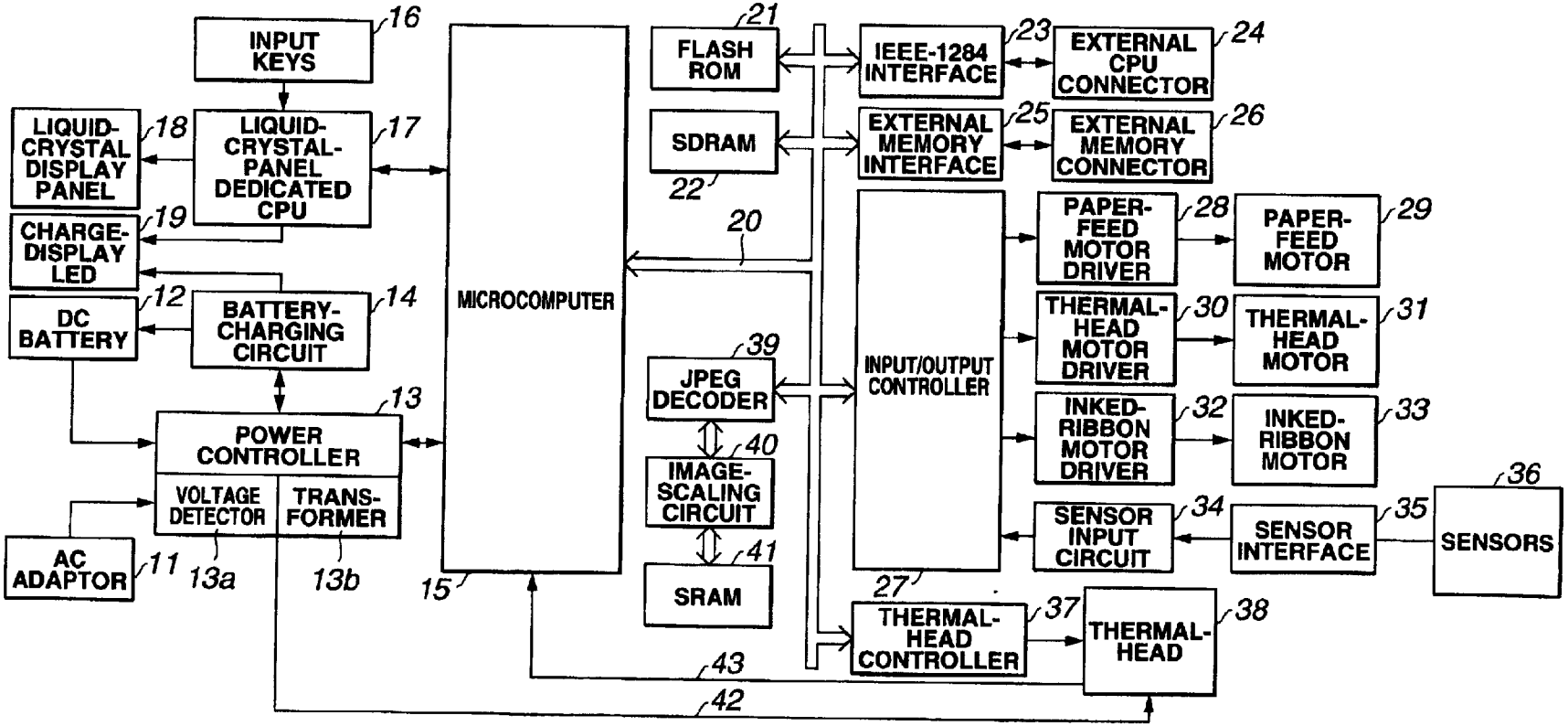
FIG. 1 is a schematic view showing the overall configuration of a printer according to a first embodiment of the present invention.
Figure 2A:
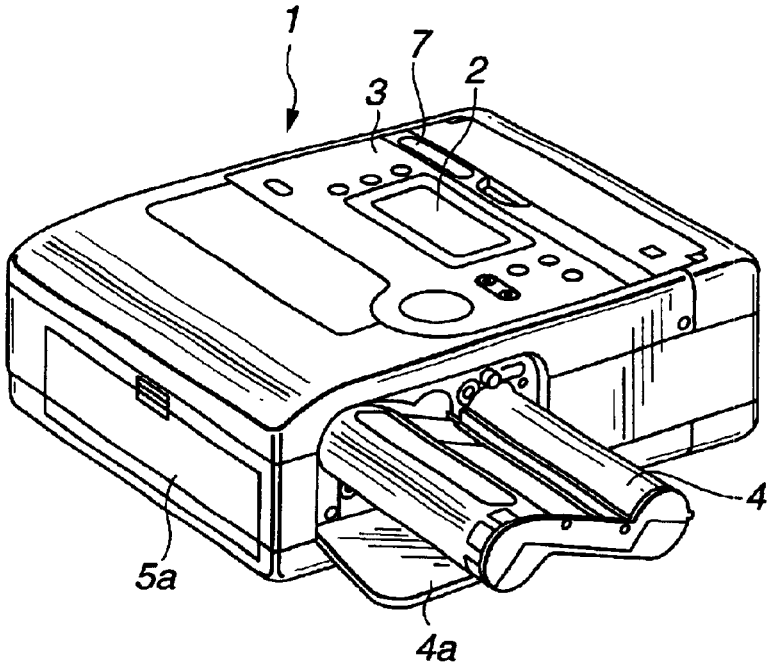
FIGS. 2A and 2B are perspective views each showing an exterior configuration of the printer of the first embodiment.
Figure 2B:
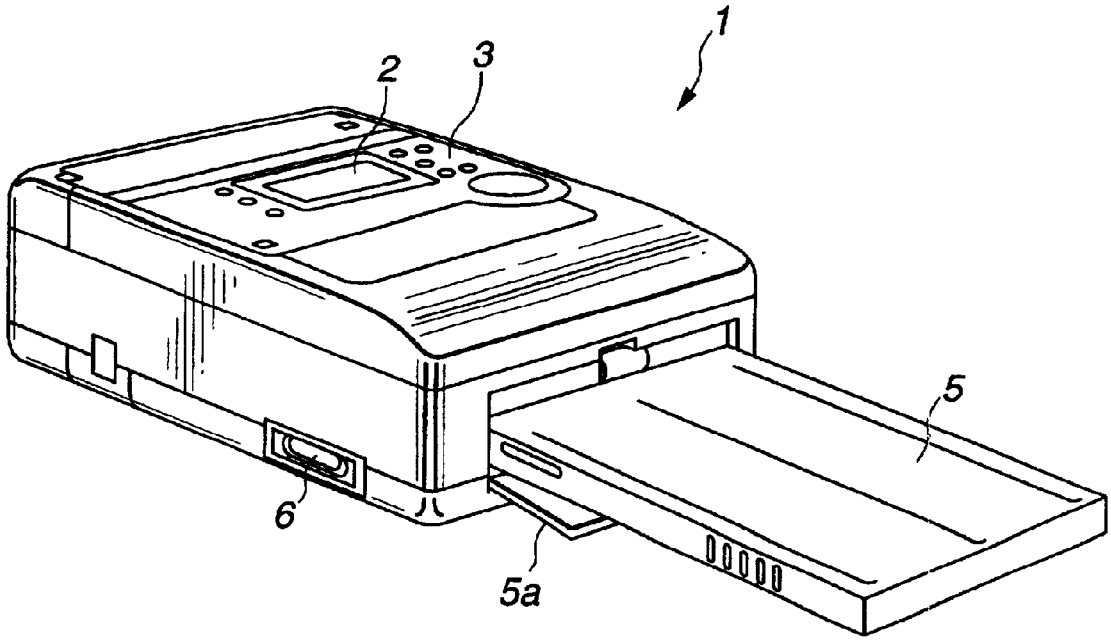
Figure 3:
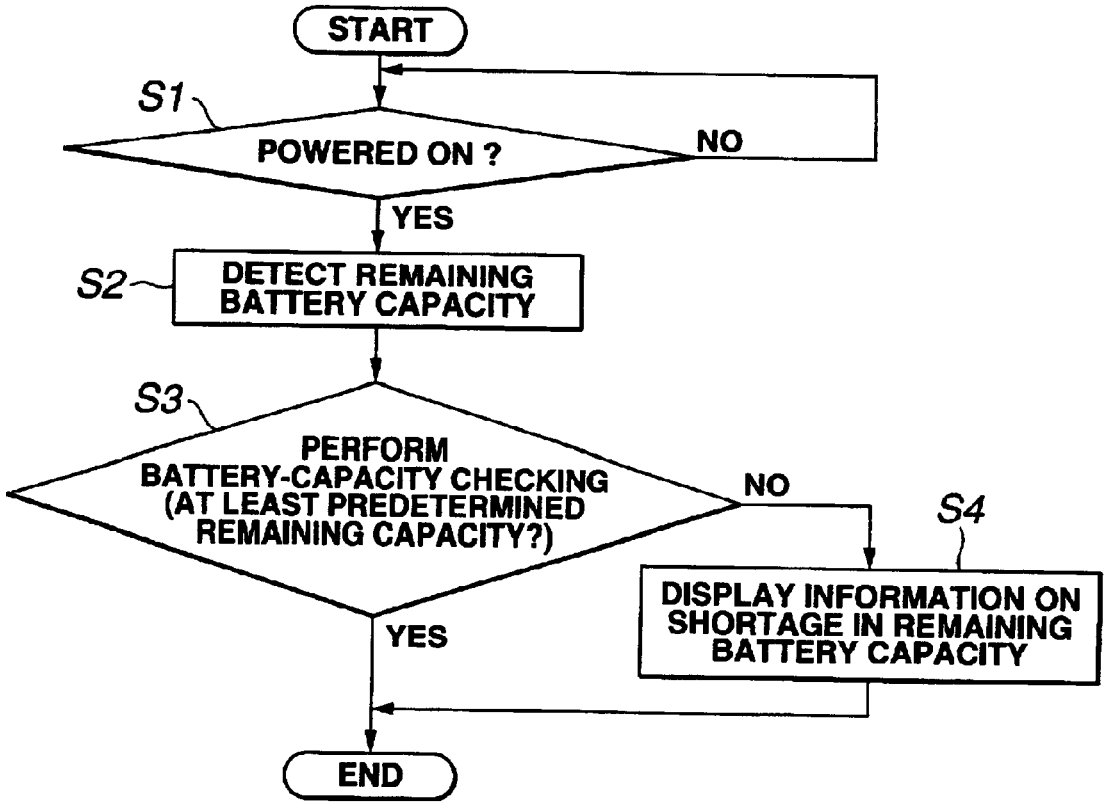
FIG. 3 is a flowchart showing an example flow of battery-capacity checking at a power-on time in the printer according to the first embodiment.
Figure 4:
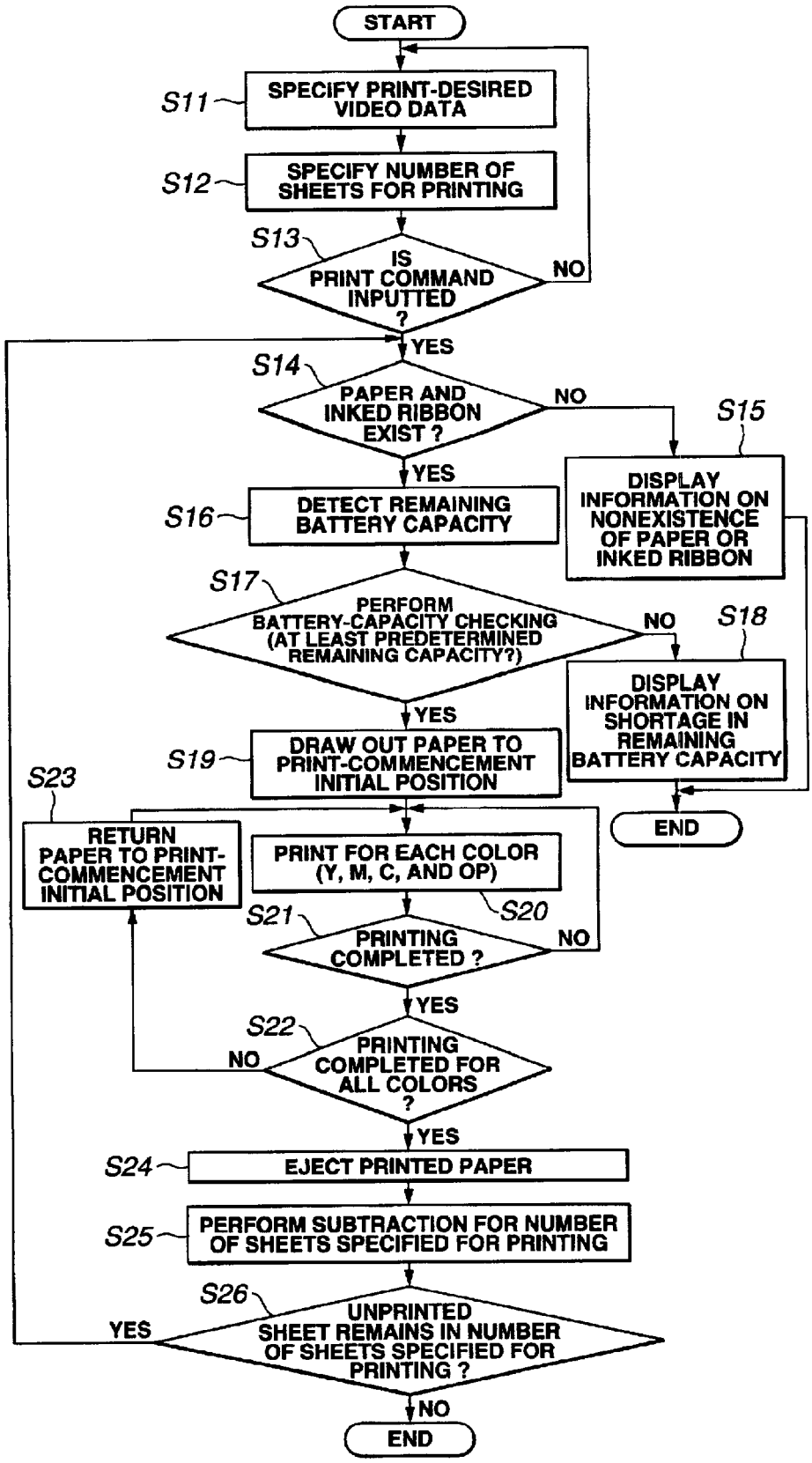
FIG. 4 is a flowchart for explaining processing to be performed in printing by the printer of the first embodiment.
Figure 5:
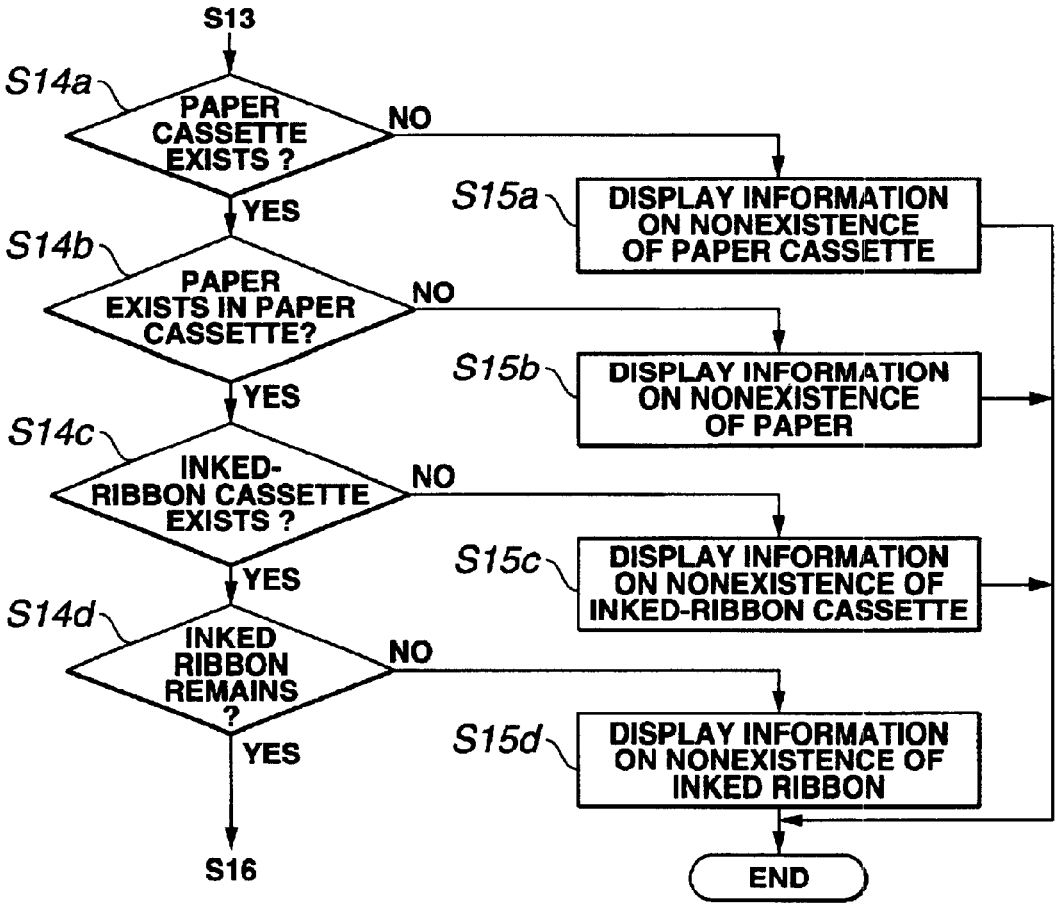
FIG. 5 is a flowchart showing an example flow of determination processing for the existence of paper and an inked ribbon in the printer of the first embodiment.

FIG. 1 is a schematic view showing the overall configuration of a printer 1 according to a first embodiment of the present invention. FIGS. 2A and 2B are perspective views each showing an exterior configuration of the printer 1 of the first embodiment. FIGS. 3 to 5 are flowcharts for explaining operations of the printer 1 according to the first embodiment.

First, referring to FIGS. 2A and 2B, a description will be made regarding an exterior configuration of the printer 1 according to the first embodiment of the present invention. The printer 1 of the present embodiment is a portable, compact, and lightweight printer that employs either a dye fusion thermal transfer printing method or a dye diffusion thermal transfer printing method. The printer 1 has an outer housing of which the overall shape is cubic. The outer housing houses a printing section, a paper feed section, a control section, power source sections, and others. That is, the outer housing houses, for example, driving mechanisms, a driving-and-controlling system, a print-signal control system, and a driving power source system. The driving mechanisms include a paper transferring mechanism, an inked-ribbon transferring mechanism, and a thermal-head driving mechanism. The driving-and-controlling system drives and controls the aforementioned driving mechanism system. The print-signal control system generates image-printing signals according to image data.

A display section 2, an input section 3, and a memory slot 7 are provided on an upper face of the printer 1. The display section 2 is formed of a liquid-crystal display device that indicates operational inputs and operational states of the printer 1. The memory slot 7 receives an external memory device described below. The input section 3 includes a plurality of switches for turning on or off the power sources of the printer 1, for selectively inputting image data to be printed, for inputting specifications of the number of sheets of the paper, and for selectively inputting specifications of various print modes.

An inked-ribbon cassette entry is provided on a right sidewall of the printer 1 as viewed in the figures. In the inked-ribbon cassette entry, an inked-ribbon cassette 4 is inserted. The inked-ribbon cassette 4 contains a feed reel and a winding reel on which an inked ribbon is wound. As shown in FIG. 2A, the inked-ribbon cassette 4 inserted from the inked-ribbon cassette entry is attached to a predetermined position in the outer housing. The inked-ribbon cassette entry can be closed by a lid 4*a*.

In the drawings, a paper-cassette insertion opening through which paper cassette 5 is inserted is provided on the front wall of the printer 1. The paper-cassette insertion opening can be closed by a lid 5*a* when the paper cassette 5 is not inserted (refer to FIG. 2A). As shown in FIG. 2B, the paper cassette 5 is a rectangular-parallelepiped box, and allows a predetermined number of sheets of paper of a predetermined size to be stacked inside. In a state where the paper cassette 5 is inserted in the paper-cassette insertion opening, and printing is performed, sheets of the paper are transferred one by one into the printer 1.

A connector 6 is provided on the left sidewall of the printer 1 as viewed on the figure. The connector 6 connects the printer 1 to an external apparatus, such as an electronic image pickup device or a computer.

A battery (not shown) is attached to a reverse side of the printer 1 to be detachable. The printer 1 has other component members (not shown) including a DC inlet connector and a light emitting diode (LED). The DC inlet connector is connected to an AC adapter that converts the commercial source power to a driving power for the printer 1. The LED displays a charge state when the aforementioned battery is charged.

Hereinbelow, an interior configuration of the printer 1 will be described with FIG. 1.

The printer 1 is driven by using two driving source powers. One of the source powers is provided through an AC adapter 11 that converts the commercial source power to a predetermined DC power. The other one of the source powers is provided from a DC battery 12. The AC adapter 11 and the DC battery 12 are connected to a power controller 13. The power controller 13 comprises a voltage detector 13*a* and a transformer 13*b*. The voltage detector 13*a* detects at least the voltage of the DC battery 12, and the transformer 13*b* generates the driving power and feeds it to various control systems and signal-processing circuits that are described below. The aforementioned DC battery 12 is of a chargeable type and is charged with power fed from the power controller 13 via a battery-charging circuit 14.

In FIG. 1, a microcomputer 15 performs the overall control for operations of the printer 1. The microcomputer 15 is connected to input keys 16 and a liquid-crystal display panel 18 via a liquid-crystal-panel dedicated microcomputer 17 (which hereinbelow will be referred to as a "liquid-crystal-panel dedicated CPU 17"). The input keys 16 include various input keys and are disposed in the input section 3. The liquid-crystal display panel 18 is disposed in the display section 2. The liquid-crystal-panel dedicated CPU 17 controls display operations of the liquid-crystal display panel 18 in response to inputs received from the input keys 16 and under the control of the microcomputer 15. In addition, upon being charged and driven by the battery-charging circuit 14, the liquid-crystal-panel dedicated CPU 17 performs display control so that a charge-display light emitting diode 19 (charge-display LED) illuminates. The charge state of the DC battery 12 is detected by the voltage detector 13*a*. According to control signals sent from the microcomputer 15, control operations are performed. For example, the LED 19 is controlled to turn OFF when charging has been completed. Also, control is performed to disable input operations, which are performed through the input keys 16, in a period in which the charge-display LED 19 illumines.

Via a bus 20, the microcomputer 15 is connected to a flash ROM 21, and a synchronous dynamic random access memory 22 (SDRAM), an IEEE-1284 interface 23, and an external memory interface 25. The flash ROM 21 permits writing of various types of system data controlled by the microcomputer 15, and stores the data. The SDRAM 22 is a buffer memory that stores image data fed from an electronic image pickup device, an external computer or an external memory. The IEEE-1284 interface 23 receives image data from the electronic image pickup device or the external computer. The external memory interface 25 reads image data from the external memory.

The IEEE-1284 interface 23 is connected to an external CPU connector 24 that connects, for example, the electronic image pickup device or the external computer. The external memory interface 25 is connected to an external memory connector 26. The external CPU connector 24 corresponds to the connector 6 shown in FIG. 2B, and the external memory connector 26 is provided in the memory slot 7 shown in FIG. 2A. The external memory connector 26 or the memory slot 7 is connected to a semiconductor memory called "SmartMedia" (registered trademark), "Compact-Flash" (registered trademark), or a "memory stick".

Via an input/output controller 27, the bus 20 is connected to a paper-feed motor driver 28, a thermal—head motor driver 30, an inked-ribbon motor driver 32, and a sensor input circuit 34. The paper-feed motor driver 28 is a driver circuit for driving and controlling a paper-feed motor 29. The paper-feed motor 29 works to draw out paper from the paper cassette 5 and to transfer the paper to an print driving system provided in the printer 1. The thermal-head motor driver 30 is a driver circuit for driving and controlling a thermal-head motor 31 that drives a thermal head to be pressed and closely engaged with or to be disengaged from a platen roller (not shown) via the inked ribbon and paper. The inked-ribbon motor driver 32 is a driver circuit for driving and controlling an inked-ribbon motor 33 that works to feed and wind the inked ribbon in the inked-ribbon cassette 4 from the feed reel onto the winding reel. Via a sensor interface 35, the sensor input circuit 34 performs input processing for detection signals sent from a plurality of sensors 36 that perform various detections. The plurality of sensors 36 include a sensor for detecting the existence of paper in the paper cassette 5 attached to the printer 1; a sensor for detecting an initial position and an end position of a paper transfer route in the printer 1, in which paper is drawn out of the paper cassette 5 and transferred; a sensor for detecting the commencement position of each color of the inked ribbon; and a sensor for detecting the peripheral temperature of the battery.

In addition, the bus 20 is connected to a thermal head 38 via a thermal-head controller 37. The thermal-head controller 37 performs electrically-conductive control for a plurality of heating elements provided in the thermal head 38 based on image data, thereby causing the heating elements to generate heat. In the thermal head 38, the plurality of heating elements are disposed perpendicular to the direction along which the paper and the inked ribbon are transferred. According to the electrically-conductive control performed by the thermal-head controller 37 for each of the plurality of heating elements, the plurality of heating elements generate heat. Thereby, coating materials of the three primary colors of yellow (Y), magenta (M), and cyan (C), and overcoating (OP) material are thermally transferred onto the paper.

Moreover, the bus 20 is connected to a JPEG decoder 39. The JPEG decoder 39 is connected to a static random access memory 41 (SRAM) via an image-scaling circuit 40. A JPEG method, which is an image compression scheme, is employed to compress image data retrieved via the IEEE-1284 interface 23 from the external computer connected to the external CPU connector 24. Alternatively, the JPEG method image is used to compress data retrieved via the external memory interface 25 from the external memory connected to the external memory connector 26. The JPEG compression data is retrieved and temporarily stored in the SDRAM 22. The retrieved JPEG compression data is sequentially read therefrom and is decoded by the JPEG decoder 39. The decoded image data is reduced or magnified by the image-scaling circuit 40 based on a scale factor to image data representing an image having a print size, and the image data is then temporarily stored in a SRAM 41. The image data temporarily stored in the SRAM 41 is read out again. Based on the image data that has been read out again, the thermal-head controller 37 drives and controls the thermal head 38, thereby allowing the image data to be printed.

A heating electric power is supplied to each of the heating elements of the thermal head 38 from the power controller 13 via a head power feed line 42. The thermal head 38 has a temperature-detecting sensor (not shown). Heat temperature data of the thermal head 38, which has been detected by the temperature-detecting sensor, is inputted to the microcomputer 15 through a temperature signal.

Hereinbelow, example operations are described.

For description, an object image is assumed to have been captured using an electronic image pickup device. Compressed image data of the object image is written to an external memory formed of, for example, a semiconductor memory, and is stored therein. The external memory containing the compressed image data is connected to the external memory connector 26 of the printer 1. Then, under the control of the microcomputer 15, the image data is retrieved and stored in the SDRAM 22 via the external memory interface 25.

For the compressed image data retrieved and stored in the SDRAM 22, a specification-inputting operation is performed. The input keys 16 are operated to perform the specification-inputting operation for print-desired data of the compressed image data, and for the number of sheets of the paper for the specified compressed image data.

After completion of the input operations performed using the input keys 16 for specifying the print-desired data of the compressed image data and the number of sheets of the paper, another specification-inputting operation is performed using the input keys 16 to commence printing. Based on the input, the microcomputer 15 commences control. According to the control, the paper-feed motor 29 is driven via the paper-feed motor driver 28 so that paper is drawn out of the paper cassette 5 and is then transferred to a predetermined paper transfer path. In addition, the microcomputer 15 performs control such that the thermal-head motor 31 is driven via the thermal-head motor driver 30, and the thermal head 38 is thereby closely engaged with the platen roller (not shown) in such a manner that the paper and the inked ribbon are sandwiched therebetween.

The compressed image data specified for printing is read out of the SDRAM 22. Then, the image data is converted by the JPEG decoder 39 and the image-scaling circuit 40 to a print signal. Then, the print signal is temporarily stored in the SRAM 41.

Subsequently, the paper-feed motor 29 and the inked-ribbon motor 33 are driven to transfer the paper and the inked ribbon in the state where they are sandwiched between the thermal head 38 and the platen roller. Concurrently, according to the compressed image data specified for printing, the thermal-head controller 37 performs supply control for the heating power that is supplied from the power controller 13 through the head power feed line 42. Then, an image according to the image data is printed on the paper.

Subsequently, a detailed description will be made regarding the print operation that is performed by using the DC battery 12.

First, a description will be made regarding processing to be performed when the printer 1 is powered on, referring to FIG. 3.

FIG. 3 is a flowchart showing an example flow of battery-capacity checking at a power-on time in the printer 1.

At step S1 (The word "step" hereinbelow will be omitted), a determination is made whether the printer 1 has been powered on. If the printer 1 has not been powered on, an answer is NO, nothing is executed until the printer 1 is powered on.

If the printer 1 has been powered on, S1 is answered as YES, and remaining battery capacity is detected (S2). Subsequent to S2, a determination is made whether the detected remaining battery capacity is higher than or equal to a predetermined capacity (predetermined remaining capacity) (S3). If the remaining capacity is lower than the predetermined remaining capacity, S3 is answered as NO, and processing proceeds to S4 where a notification of shortage in remaining battery capacity is displayed, and processing then terminates. On the other hand, if S3 is answered as YES, nothing is executed, and processing proceeds to other processing shown in FIG. 4 and the other relevant drawing.

In this way, immediately after a driving-power switch of the printer 1 has been turned ON, the remaining capacity of the DC battery 12 is detected, and a determination is made whether the DC battery 12 has a remaining battery capacity sufficient to perform printing on at least one sheet of paper. Thus, battery-capacity checking can be performed before the specification-inputting operation for printing is performed.

Hereinbelow, a flow of processing in printing will be described. FIG. 4 is a flowchart showing processing to be performed in printing.

First, at S11, a user performs an input operation by using the input keys 16 to specify print-desired data of the compressed image data retrieved and stored in the SDRAM 22. At S12, the number of sheets of paper that correspond to the image data specified through the input keys 16 at S11 is input by using the input keys 16.

Subsequently, at S13, a determination is made to verify the input of the print specification, that is, the input of a print command. If the print specification is determined not to have been input, S13 is answered as NO, and processing returns to S11. If the input of the print specification is verified, an answer is YES, and processing proceeds to S14. Then, determinations are made whether paper is stored in the paper cassette 5, whether the inked-ribbon cassette 4 is set in the printer 1, and whether ink remains sufficient to perform printing on one sheet of the paper (S14). To allow the detection of the remaining ink amount, symbols or the like are indicated at commencement ends of the portions of the three primary colors and the overcoating material in the inked ribbon, and the symbols or the like are detected by an inked-ribbon detecting sensor, which is one of the various sensors 36. By this arrangement, base ends of the three-primary-color portions, and the remaining amount of the inked ribbon can be recognized.

At step S14, if a determination is made that the paper does not exist or that the remaining amount of the inked ribbon is insufficient, step 14 is answered as NO. In this case, the liquid-crystal-panel dedicated CPU 17 is driven, the liquid-crystal display panel 18 displays information that no paper exists or that the remaining amount of the inked ribbon is insufficient, and the print-commencement operation is terminated (S15). Then, processing terminates.

If S14 is answered as YES, processing proceeds to S16, and the voltage detector 13*a* detects the currently remaining power capacity of the DC battery 12 (S16). Then, a determination is made whether the currently remaining power capacity of the DC battery 12 is at a level higher than or equal to a predetermined level of remaining capacity (threshold) (S17).

The predetermined level of remaining capacity is represented by a value representing the power required to drive the paper-feed motor 29, the thermal-head motor 31, the inked-ribbon motor 33, and the thermal head 38. Consequently, printing can be performed on at least one sheet of the paper. The predetermined level of remaining capacity is represented by a preliminary set value obtained through calculations, measurements, and the like of driving power required to perform printing on one sheet of the paper. The predetermined level of remaining capacity, which is used in S3 shown in FIG. 3, is set in the same way as above.

At S17, if the currently remaining power capacity of the DC battery 12 is lower than the predetermined value, that is, if transfer and printing for one sheet of the paper which are performed subsequent to the detection of the remaining capacity level of the DC battery 12 cannot be completed with the currently remaining power capacity, S17 is answered as NO. In this case, the liquid-crystal-panel dedicated CPU 17 is driven and controlled to command the liquid-crystal display panel 18 to display information on shortage in the remaining capacity of the DC battery 12, and the command for commencing print operation is reset (S18). This allows the user of the printer 1 to recognize the shortage in the remaining capacity of the DC battery 12 and to replace or charge the DC battery 12.

At S17, if the currently remaining power capacity of the DC battery 12 is higher than or equal to the predetermined level of remaining capacity, S17 is answered as YES, and processing proceeds to S19.

At S19, the paper-feed motor 29 is driven through the input/output controller 27 and the paper-feed motor driver 28. Thereby, paper stored in the paper cassette 5 is drawn out, and the edge of the paper is set to a print-commencement position.

Subsequently, at S20, the thermal-head motor 31 is controlled and driven by the input/output controller 27 through the thermal-head motor driver 30. Thereby, the thermal head 38 is closely engaged with the platen roller in a state where a Y-color ink portion of the inked ribbon and the paper is sandwiched therebetween. By driving the paper-feed motor 29 and the inked-ribbon motor 33, the thermal head 38 is heated and driven under the driving control of the thermal-head controller 37, and thermal transfer printing is performed.

Subsequently, at S21, a determination is made whether the printing has been completed. If the printing is determined at S21 not to have been completed, processing returns to S20. If printing is determined to have been completed, S21 is answered as YES. Subsequently, at S22, a determination is made whether printing with all the colors, i.e., all the colors of the three primaries and the overcoating material, has been completed. At S22, if printing only with the Y color is determined to have been completed, and printing with the other colors is determined not to have been completed, processing proceeds to S23. At S23, the thermal-head motor 31 is driven, the thermal head 38 is disengaged from the platen roller, the operation of the inked-ribbon motor 33 is stopped, the paper-feed motor 29 is reversely driven, the paper for which the Y-color printing has been completed is returned to the print-commencement initial position, and printing with the subsequent M color is commenced at S20. In this way, the routine of S20 to S23 is iterated, and printing is performed sequentially with the Y, M, and C colors and the overcoating (OP).

When printing with the colors up to that of the overcoating (OP) is confirmed to have been completed at S22, the printed paper is transferred outside of the printer 1 at S24. Then, at S25, subtraction from a value representing the specified number of sheets of the paper is performed. Subsequently, at S26, a determination is made whether a number of unprinted sheets of the paper are included in the specified number of sheets of the paper. If a number of unprinted sheets of the paper are determined to be included therein, S26 is answered YES, processing returns to S14, and the processing is iterated within the routine starting with the determination for remaining amounts of the inked ribbon and the paper in order to commence printing on the second sheet of the paper. At S26, all the specified number of sheets of the paper is determined to have been printed, the print operation terminates.

As described above, also when printing is consecutively performed on a plurality of sheets of the paper according to the image data and the number of sheets of the paper that were input and specified at S11 and S12, the currently remaining power capacity of the DC battery 12 is detected immediately before a paper-feed operation is performed when printing is commenced on each sheet of the paper. Thereby, a determination is made whether the currently remaining power capacity is at a driving-power level required to perform printing on one sheet of the paper, and printing is executed only when the remaining capacity of the DC battery 12 is at the required level. When the level of the remaining capacity of the DC battery 12 does not reach the required level, a paper transfer operation is not performed, and a warning is displayed to notify the user of shortage in the battery capacity.

The above enables the prevention of termination that can occur partway during printing because of shortage in remaining battery capacity. In addition, at S26, when a number of unprinted sheets of the paper are included in the number of sheets of the paper, which have been input at S12, processing returns to S14. At S14, when printing is performed on another sheet of the paper, if the remaining battery capacity detected at S16 is determined to be insufficient, the microcomputer 15 performs control such that data representing the unprinted sheets of the paper is stored, and only the stored data is printed after the DC battery 12 has been replaced with new one.

Hereinbelow, referring to FIG. 5, a description will be made regarding a practical example of the processing of determining the existence of the paper and the inked ribbon. FIG. 5 is a flowchart showing an example flow of the determination processing for the existence of the paper and the inked ribbon.

The following will describe a practical example of the determination performed at S14 for the existence of the paper and the inked ribbon, and a practical example of a non-existence case at S15 for the paper or the inked ribbon. At S14*a*, a determination is made for the existence of the attached paper cassette 5. If the paper cassette 5 is determined at S14*a* not to have been attached, a warning is displayed at S15*a* to notify that the paper cassette 5 is not attached. If the paper cassette 5 is determined to have been attached, a determination is made at S14*b* for the existence of the paper stored in the paper cassette 5.

As a result of the determination at S14*b*, if the paper is determined not to have been stored in the paper cassette 5, a warning is displayed at S15*b* to notify that the paper does not exist. If the paper is determined to have been stored in the paper cassette 5, a determination is made at S14*c* for the existence of the inked-ribbon cassette 4.

In the determination at S14*c*, if the inked-ribbon cassette 4 is determined not to have been attached, a warning is displayed at S15*c* to notify that the inked-ribbon cassette 4 does not exist. If the inked-ribbon cassette 4 is determined to have been attached, a determination is made at S14*d* for the existence of the remaining amount of the inked ribbon in the inked-ribbon cassette 4.

As a result of the determination at S14*d*, if the remaining amount of the inked ribbon in the inked-ribbon cassette 4 is determined not to exist, a warning is displayed at S15*d* to notify that the inked ribbon does not exist. If the remaining amount of the inked ribbon is determined to exist, S16 and the subsequent steps are executed.

As described above in detail, in the printer 1 of the present embodiment, the remaining capacity level of the DC battery 12 is detected immediately before one sheet of the paper is fed for printing. Then, the determination is made whether the detected remaining capacity level of the DC battery 12 is at a level required to perform a print-driving operation for one sheet of the paper. Consequently, only when the DC battery 12 has a power sufficient to perform printing on one sheet of the paper, the print-driving operation is performed. This enables the prevention of termination that can occur partway of printing, and in addition, enables printing to be performed with desired coloration and density on at least one sheet of the paper.

Also when printing is consecutively performed on a plurality of sheets of the paper according to the same image data, the detection for the remaining capacity of the DC battery 12 and the determination for the remaining capacity level thereof are performed immediately before each sheet of the paper is fed for printing. In the course of printing on the plurality of sheets of the paper, suppose a shortage has occurred in the remaining battery capacity required to perform printing on the subsequent sheets of the paper after printing has been performed on a number of sheets of the paper. In this case, a warning is displayed to notify the user of the shortage in the battery power, and concurrently, a number of unprinted sheets of the paper is displayed on the liquid-crystal display panel 18. Thereby, the user can easily recognize the remaining number of sheets of the paper on which printing is required to be performed.

The electromotive force of a DC battery is variable depending the temperature in the peripheral environment of the DC battery 12. For this reason, the temperature sensor, i.e., the temperature detector, is provided for detecting the temperature in the peripheral environment of the DC battery 12. The remaining capacity level of the DC battery 12 is calculated by using data representing the temperature detected by the temperature sensor and a value representing the detected remaining capacity of the DC battery 12. Then, the calculated remaining capacity level is compared with the predetermined level of the remaining capacity required for the performing the print-driving operation. Thereby, the remaining capacity of the DC battery 12 can be effectively used as a printing-driving power source. In practice, for example, a change is made for the determination criterion used to determine whether the transfer operation and the printing operation for one sheet of the paper can be completed corresponding to the detection result of the temperature sensor (temperature-measuring means). In other words, the threshold for the battery-capacity checking is changed corresponding to the degree of the temperature in the peripheral environment of the DC battery 12.

In the above-described printer 1 of the present embodiment, also when printing is performed on the plurality of sheets of the paper corresponding to the configuration using the DC battery 12 as the source power, battery-capacity checking is performed before each sheet of the paper is fed for printing, and printing is controlled to securely terminate after the paper has been fed out. As a result of the battery-capacity checking, if a determination is made that printing cannot be completed for data corresponding to another sheet of the paper subsequent to the battery-capacity checking, paper feed is not commenced. Furthermore, in the printer 1, since the battery-capacity checking is performed each time one sheet of the paper is fed for printing, the remaining capacity of the DC battery 12 can be fully used. This increases the number of printable sheets of the paper (the "printable sheets" hereinbelow refers to sheets on which printing can be performed with a battery capacity).

In this way, the printer 1 of the present embodiment controls the print operation such that the level of remaining battery capacity is detected immediately before the paper-feed operation is performed for the first sheet of the paper for the print operation that is commenced corresponding to specifications input for commencing the print operation. Furthermore, the printer 1 controls the print operation such that when printing is consecutively performed on the plurality of sheets of the paper corresponding to specifications for commencing the print operation, the level of remaining battery capacity is also detected immediately before the paper-feed operation is performed for each of the plurality of sheets of the paper for the print operation.

Conventionally, for example, when ten sheets of the paper is specified for the number of sheets of the paper, a determination is made whether printing can be performed on all the ten sheets of the paper. As a result, if printing is determined to be possible, printing is consecutively performed on all the ten sheets of the paper. In this conventional case, while printing may be impossible for all the ten sheets of the paper, also when the remaining battery capacity is at a level sufficient to perform printing on, for example, three sheets of the paper, information the remaining battery capacity is determined to be displayed in a message saying, for example, "shortage in the battery capacity", and consequently, printing cannot be performed. However, when the above-described printer 1 of the present embodiment is used in the aforementioned situation, also when ten sheets of the paper is specified for printing, printing can be performed on up to three sheets of the paper. When the printer is designed by placing importance on the portability, a small battery having a low capacity needs to be used. However, according to the present embodiment, even with a low-capacitance battery being used, the number of printable sheets of the paper can utmost be increased.

In the above-described printer 1 of the first embodiment, battery-capacity checking is performed immediately before the paper is drawn out of the paper cassette 5 for printing. If a number of sequences are involved between the battery-capacity checking and the paper feed operation, a slight voltage drop can occur therebetween. The battery-capacity checking is iterated in units of the print operation for one sheet of the paper. For example, also when ten sheets of the paper is specified for the number of sheets of the paper in a case where printing on ten sheets of the paper is impossible, the print requirement is not reset, and printing is executed if printing can still be performed on, for example, one sheet of the paper. Furthermore, the printer 1 performs battery-capacity checking each time printing is performed on one sheet of the paper, thereby enabling battery service life to be prolonged.

The first embodiment employs the method in which the remaining capacity of the DC battery 12 is detected, and the determination is made whether the remaining capacity is at a power level sufficient to perform printing on one sheet of the paper. However, the method may be modified as follows. Based on a value of the power required for performing a print-driving for one sheet of the paper, calculations are performed to obtain the number of sheets of the paper on which printing can be performed. Then, the number of printable sheets of the paper is obtained from the calculation result and the remaining capacity of the DC battery 12, and the number of printable sheets of the paper sheets is displayed on the liquid-crystal display panel 18.

In this way, according to the above-described printer 1, the remaining capacity of the DC battery 12 is detected immediately before each sheet of the paper is fed for printing. When the detected remaining capacity of the DC battery 12 is not at a driving-power level sufficient to perform printing on at least one sheet of the paper, paper feed operation is stopped, and display is performed to notify the user of shortage in the remaining capacity of the DC battery 12. In addition, when printing is performed on a plurality of sheets of the paper, a number of unprinted sheets of the paper are also displayed. Thereby, printing can be executed immediately before the DC battery 12 is depleted, and printing can be resumed with the first sheet of the unprinted paper.

Hereinbelow, a second embodiment of the present invention will be described.

A printer of the second embodiment has substantially the same configuration as that of the printer of the first embodiment described with reference to FIGS. 1 to 5. Description relative to FIGS. 1 to 5 will therefore be omitted. Hereinbelow, with reference to FIG. 6, a description will be made regarding the difference of the first embodiment.

Figure 6:
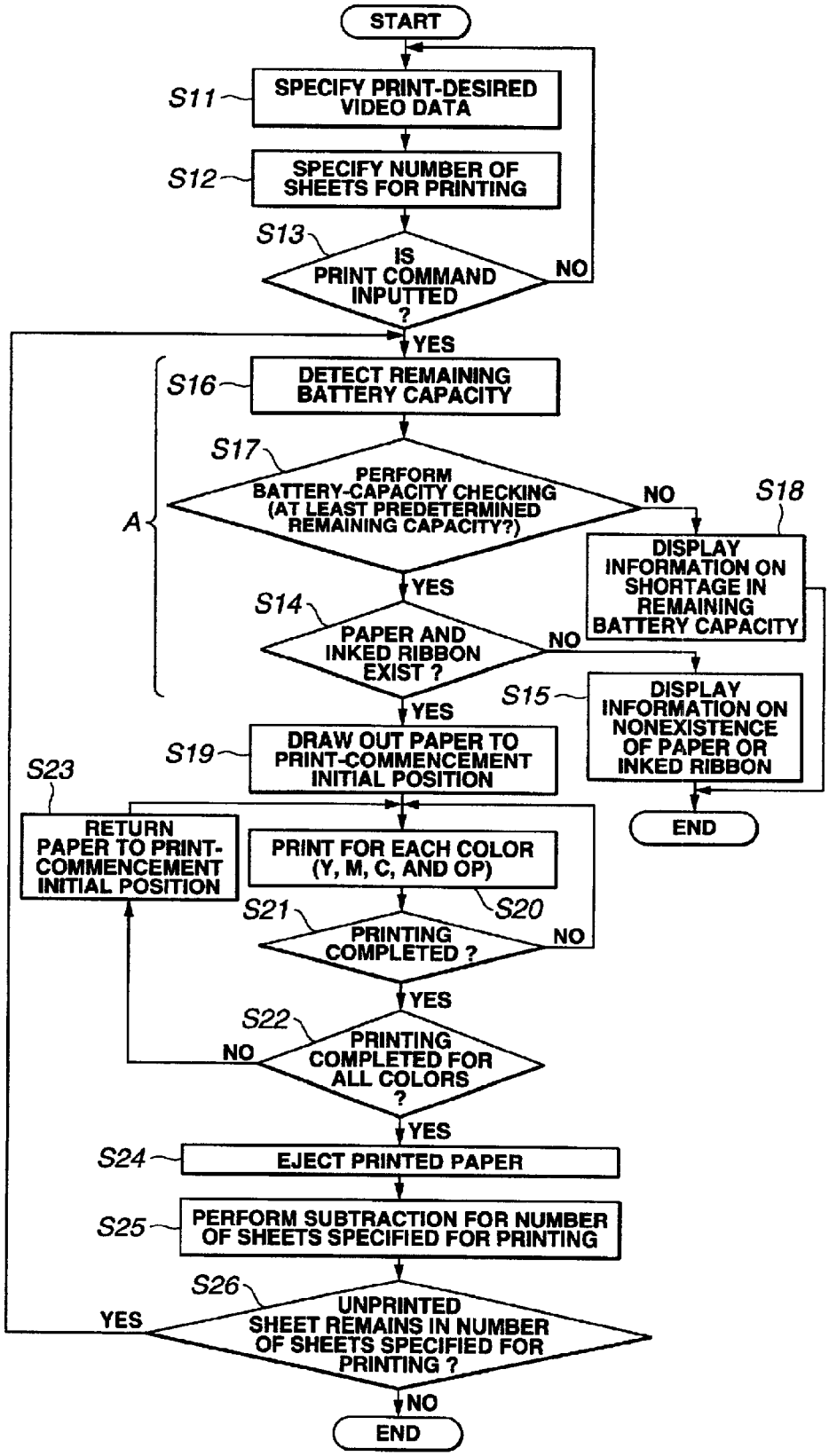
FIG. 6 is a flowchart showing processing to be performed in printing by a printer according to a second embodiment of the present invention.

FIG. 6 corresponds to FIG. 4 regarding the first embodiment. That is, FIG. 6 is a flowchart showing processing to be performed in printing by the printer according to the second embodiment. Since the flowchart is substantially the same as that shown in FIG. 4, the individual steps of the same processing as those shown in FIG. 4 are represented by the same step numbers.

The difference in this case is the sequence of processes at S14 to S18 shown by the letter A. After the battery-capacity checking has been performed at S17, the determination at S14 is performed for the existence of the paper and the inked ribbon. In the determination at S14 for the existence of the paper and the inked ribbon, since only checking is performed for outputs of the various sensors, the power consumption therein is low. Also after the battery-capacity checking has been performed, while the remaining capacity of the battery is slightly reduced by the S14, printing can still be performed at a high probability.

Also in the printer configured according to the second embodiment, since substantially the same advantages as those of the first embodiment can be obtained, description of the advantages is also omitted.

Hereinbelow, a third embodiment of the present invention will be described.

A printer of the third embodiment has substantially the same configuration as that of either the printer of the first embodiment described with reference to FIGS. 1 to 5 or the printer of the second embodiment described with reference to FIGS. 1 to 6. Description relative to FIGS. 1 to 6 will therefore be omitted. Hereinbelow, with reference to FIG. 7, a description will be made regarding only portions and matters different from those of the first embodiment and the second embodiment.

Figure 7:
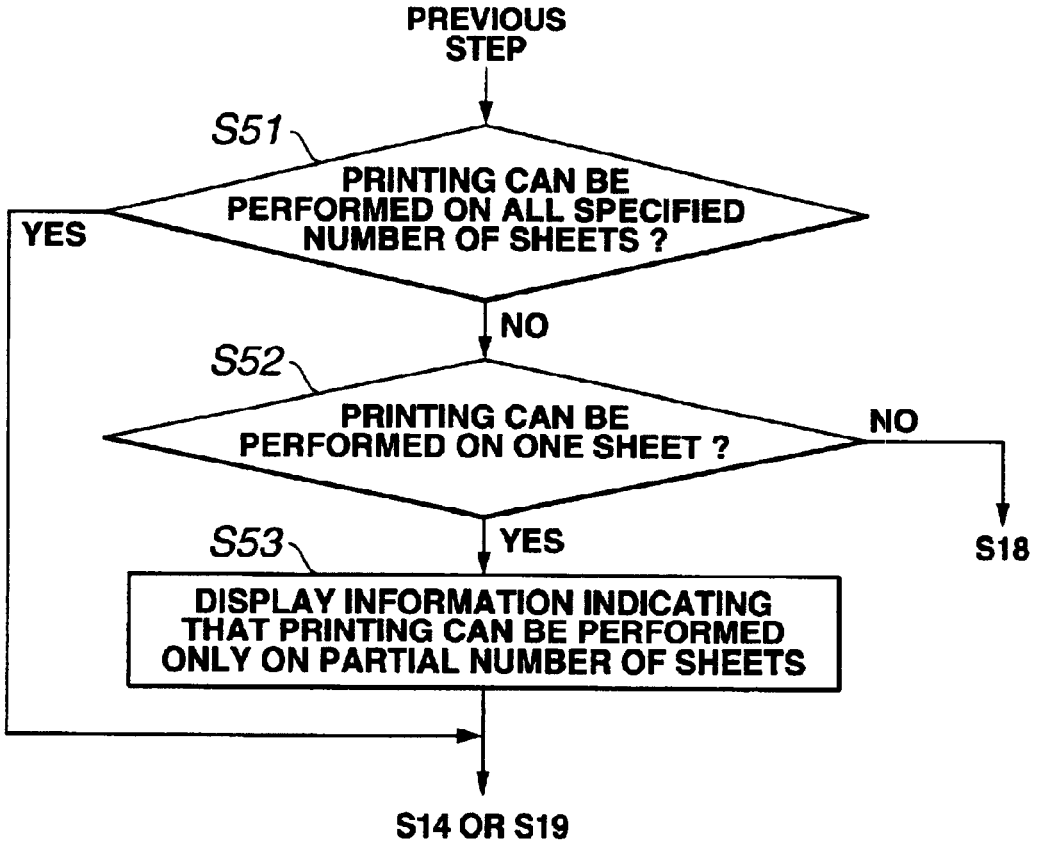
FIG. 7 is a flowchart showing processing to be performed in printing by a printer according to a third embodiment of the present invention.

FIG. 7 is a flowchart showing processing to be performed in printing by a printer according to a third embodiment of the present invention. In FIG. 7, a modification is added to S17 shown in FIG. 4 regarding the first embodiment and FIG. 6 regarding the second embodiment. After S16 at which the remaining battery capacity has been detected, determination processing is added to determine whether all the specified number of sheets of the paper can be consecutively printed.

As described above, after the remaining battery capacity has been detected at S16, the determination is made whether all the specified number of sheets of the paper can be consecutively printed (S51). Specifically, the aforementioned determination is made whether the remaining battery capacity detected at S16 is higher than or equal to a predetermined remaining capacity (first threshold). If the remaining battery capacity is higher than or equal to the first threshold, S51 is answered as YES, and processing proceeds either to S19 (in the first embodiment) or to S14 (in the second embodiment). For example, the first threshold is obtained through a calculation that is carried out such that an experimentally obtained power consumption for one printed sheet of paper is used as a coefficient, and based on the coefficient, multiplication is carried out with an input value representing the number of sheets of the paper. If the remaining battery capacity detected at S16 is lower than the predetermined remaining capacity (first threshold), S51 is answered as NO, and processing proceeds to S52. At S52, a determination is made whether the remaining battery capacity detected at S16 is higher than or equal to a predetermined remaining capacity (second threshold). The second threshold is similar to the remaining capacity level at S17 used in the first and second embodiments to determine whether one sheet of the paper can be printed.

When S52 is answered as NO, that is, when printing cannot be performed even on one sheet of the paper, processing proceeds to S18. On the other hand, when S52 is answered as YES, processing proceeds to S53, and display processing is performed to notify that printing can be performed only on a partial number of sheets of the paper (S53). Then, processing proceeds either to S19 (in the first embodiment) or to S14 (in the second embodiment).

In the above-described operational method, also when all the specified number of sheets of the paper cannot be printed, the battery can be used until printing on the last sheet of the paper is completed. Furthermore, also when printing cannot be performed on all the specified number of sheets of the paper, that is, when the level of remaining battery capacity detected by a battery voltage detector is determined to be at a level sufficient to complete only a partial number of sheets of a plurality of sheets of the paper specified for paper transfer operations and print operations, a notification to that effect is displayed so that the user can easily understand the operational condition. This improves user-friendly characteristics of the printer. When the remaining capacity is determined to be at the level sufficient to complete only a partial number of sheets of the paper, a display may be presented to notify the user of the number of sheets of the paper that can be printed by using the battery capacity remaining in the stage of S53.

In the printer of the present invention, the remaining capacity of the battery power source is detected immediately before each sheet of the paper is fed for printing, the print-driving operation is performed only when the battery power source has a remaining capacity sufficient to perform printing on at least one sheet of the paper. This asserts termination that can occur partway during a print operation because of the depletion in the battery power source. In addition, printing can be performed with predetermined coloration and density. Furthermore, when the battery power source is at a level insufficient to perform the print-driving operation for one sheet of the paper, a warning is displayed on the display section to notify the user of shortage in the battery capacity, and concurrently, the print-driving terminates. This method is advantageous in that the user can easily recognize timing with which batteries are replaced with new ones.

Having described the preferred embodiments of the invention referring to the accompanying drawings, it should be understood that the present invention is not limited to those precise embodiments, and various changes and modification thereof could be made by one skilled in the art without departing from the spirit or scope of the invention as defined in the appended claims.

What is claimed is:

1. A printer comprising:

a printing section for performing printing on paper;

a paper feed section for transferring paper, which is fed from a paper feed cassette, to said printing section;

a battery power source;

a remaining-battery-capacity detector for detecting a remaining-battery-capacity level of said battery power source;

a print-operation-commencement specifying section for specifying print-operation commencement;

a power-on specifying section for specifying power-on of the printer; and control section for performing print-operation control wherein said control section determines whether a paper transfer operation of, and a print operation on, at least one sheet of paper are possible when the remaining-battery-capacity detector has detected a remaining-battery-capacity level at a first time corresponding to a specification of power-on of the printer by the power-on specifying section, and subsequently, after the print-operation-commencement specifying section has specified print-operation commencement, performs the print-operation control such that said remaining-battery-capacity detector is used to detect the remaining battery capacity level immediately before a paper transfer operation is commenced for the first sheet of the paper for a print operation which is commenced corresponding to a print-operation commencement specification received from said print-operation-commencement specifying section, and performs the print-operation control such that when printing is consecutively performed on a plurality of sheets of the paper corresponding to said print-operation commencement specification, said remaining-battery-capacity detector is used to detect the remaining battery capacity level immediately before the paper transfer operation is performed for the print operation for each of the plurality of sheets of the paper.

2. A printer as defined in claim 1, wherein said battery power source is connected to a main unit of said printer to be removable.

3. A printer as defined in claim 1, further comprising a determination section for determining whether a paper-transfer operation and the print operation to be performed subsequent to the detecting operation for the remaining battery capacity level can be completed for at least one sheet of the paper according to the remaining battery capacity level detected by said remaining-battery-capacity detector.

4. A printer as defined in claim 3, wherein, when said determination section determines the remaining battery capacity level detected by said remaining-battery-capacity detector to be insufficient to complete the paper-transfer operation and the print operation, which are performed subsequent to the detecting operation for the remaining battery capacity level, for at least one sheet of the paper, control is performed not to commence the paper-transfer operation.

5. A printer as defined in claim 3, wherein, when said determination section determines the remaining battery capacity level detected by said remaining-battery-capacity detector to be insufficient to complete the paper-transfer operation and the print operation, which are performed subsequent to the detecting operation for the remaining battery capacity level, for at least one sheet of the paper, a display unit displays information indicating that the remaining battery capacity is short.

6. A printer as defined in claim 3, wherein, when printing is specified to be consecutively perform the plurality of sheets of the paper corresponding to a specification received from said print-operation-commencement specifying section, said determination section determines whether the transfer operations is and the print operations can be completed all for the specified plurality of sheets of the paper according to the remaining battery capacity level detected by said remaining-battery-capacity detector.

7. A printer as defined in claim 6, wherein, when said determination section determines the remaining battery capacity level detected by said remaining-battery-capacity detector to be sufficient only to complete the paper-transfer operations and the print operations for partial number of sheets of the paper in the paper-transfer operations and the print operations for the specified plurality of sheets of the paper, said display unit displays information indicating that printing can be performed only for the partial number of sheets of the paper.

8. A printer as defined in claim 7, wherein said display unit displays a number of printable sheets of the paper for the information indicating that printing can be performed only for the partial number of sheets of the paper.

9. A printer as defined in claim 3, further comprising a temperature detector for detecting the temperature in a peripheral environment of said battery power source, wherein a determination criterion used in said determination section is changed according to the detection result of said temperature detector, said determination criterion being used to determine whether the paper-transfer operation and the print operation, which are performed subsequent to the detection operation for the remaining battery capacity level, can be completed for at least one sheet of the paper.

10. A printer comprising:

a printing section for performing printing on paper;

a paper feed section for transferring paper, which is fed from a paper feed cassette, to said printing section;

a remaining-battery-capacity detector for detecting a remaining-battery-capacity level of a battery power source;

a print-operation-commencement specifying section for specifying print-operation commencement;

a power-on specifying section for specifying power-on of the printer; and a control section wherein said control section determines whether a paper transfer operation of, and a print operation on, at least one sheet of paper are possible when the remaining-battery-capacity detector has detected a remaining-battery-capacity level at a first time corresponding to the specification of power-on of the printer by the power-on specifying section, and subsequently, after the print-operation-commencement specifying section has specified print-operation commencement, performs print-operation control based on the remaining battery capacity level detected by said remaining-battery-capacity detector immediately before a paper transfer operation is commenced for the first sheet of the paper for a print operation which is commenced corresponding to a print-operation commencement specification received from said print-operation-commencement specifying section, and when printing is consecutively performed on a plurality of sheets of the paper corresponding to said print-operation commencement specification, said control section performs print-operation control based on the detected remaining battery capacity level immediately before the paper transfer operation is performed for the print operation for each of the plurality of sheets of the paper.

11. A printer as defined in claim 10, further comprising a battery power source that is connected to a main unit of said printer to be removable.

12. A printer as defined in claim 10, further comprising a determination section for determining whether a paper-transfer operation and the print operation to be performed subsequent to the detecting operation for the remaining battery capacity level can be completed for at least one sheet of the paper according to the remaining battery capacity level detected by said remaining-battery-capacity detector.

13. A printer as defined in claim 12, wherein, when said determination section determines the remaining battery capacity level detected by said remaining-battery-capacity detector to be insufficient to complete the paper-transfer operation and the print operation, which are performed subsequent to the detecting operation for the remaining battery capacity level, for at least one sheet of the paper, control is performed not to commence the paper-transfer operation.

14. A printer as defined in claim 12, wherein, when said determination section determines the remaining battery capacity level detected by said remaining-battery-capacity detector to be insufficient to complete the paper-transfer operation and the print operation, which are performed subsequent to the detecting operation for the remaining battery capacity level, for at least one sheet of the paper, a display unit displays information indicating that the remaining battery capacity is short.

15. A printer as defined in claim 12, wherein, when printing is specified to be consecutively perform the plurality of sheets of the paper corresponding to a specification received from said print-operation-commencement specifying section, said determination section determines whether the transfer operations and the print operations can be completed all for the specified plurality of sheets of the paper according to the remaining battery capacity level detected by said remaining-battery-capacity detector.

16. A printer as defined in claim 15, wherein, when said determination section determines the remaining battery capacity level detected by said remaining-battery-capacity detector to be sufficient only to complete the paper-transfer operations and the print operations for partial number of sheets of the paper in the paper-transfer operations and the print operations for the specified plurality of sheets of the paper, said display unit displays information indicating that printing can be performed only for the partial number of sheets of the paper.

17. A printer as defined in claim 16, wherein said display unit displays a number of printable sheets of the paper for the information indicating that printing can be performed only for the partial number of sheets of the paper.

18. A printer as defined in claim 12, further comprising a temperature detector for detecting the temperature in a peripheral environment of said battery power source, wherein a determination criterion used in said determination section is changed according to the detection result of said temperature detector, said determination criterion being used to determine whether the paper-transfer operation and the print operation, which are performed subsequent to the detection operation for the remaining battery capacity level, can be completed for at least one sheet of the paper.

19. A printer comprising:

a printing section for performing printing on paper;

a paper feed section for transferring paper, which is fed from a paper feed cassette, to said printing section;

a battery power source;

a remaining-battery-capacity detector for detecting a remaining-battery-capacity level of said battery power source;

a print-operation-commencement specifying section for specifying print-operation commencement;

a power-on specifying section for specifying power-on of the printer; and control section for performing print-operation control wherein, at a first time corresponding to a specification of power-on of the printer by the power-on specifying section, said control section determines whether both a paper transfer operation of at least one sheet of paper and a print operation on the at least one sheet of paper are possible using a remaining-battery-capacity level detected by the remaining-battery-capacity detector, wherein at a second time, after the print-operation-commencement specifying section has specified print-operation commencement, said control section determines whether both a paper transfer operation of at least one sheet of paper and a print operation on the at least one sheet of paper are possible using a remaining battery capacity level detected by the remaining-battery-capacity detector immediately before a paper transfer operation is commenced for a first sheet of the paper for a print operation which is commenced corresponding to the print-operation commencement specification received from said print-operation-commencement specifying section, and wherein said control section performs the print-operation control such that when printing is consecutively performed on a plurality of sheets of the paper corresponding to said print-operation commencement specification, said remaining-battery-capacity detector is used to detect the remaining battery capacity level immediately before the paper transfer operation is performed for the print operation for each of the plurality of sheets of the paper.

* * * * *